United States Patent [19]

Berstein et al.

[11] Patent Number: 4,539,831

[45] Date of Patent: Sep. 10, 1985

[54] METHOD FOR SETTING THE STROKE OF MOVABLE ROLLING UNITS, AND CRANKSHAFT ROLLING MACHINE FOR IMPLEMENTING SAID METHOD

[75] Inventors: Garri Berstein; Willi Hansen; Rudolf Winkens, all of Erkelenz, Fed. Rep. of Germany

[73] Assignee: Wilhelm Hegenscheidt GmbH, Erkelenz, Fed. Rep. of Germany

[21] Appl. No.: 562,963

[22] Filed: Dec. 19, 1983

[30] Foreign Application Priority Data

Jun. 6, 1983 [DE] Fed. Rep. of Germany ..... 3320370

[51] Int. Cl.[3] ..... B21H 7/00

[52] U.S. Cl. ..... 72/110; 72/81

[58] Field of Search ..... 72/81, 107, 110, 111; 29/6

[56] References Cited

U.S. PATENT DOCUMENTS 4,437,328 3/1984 Wittkopp et al. ..... 72/110

*Primary Examiner*—Lowell A. Larson

*Attorney, Agent, or Firm*—Arthur B. Colvin

[57] ABSTRACT

A crankshaft rolling machine includes a pair of model crankshafts mounted for synchronous rotation. One or more crankshaft rolling units are coupled to the model crankshafts in a manner enabling adjustment of the units along a linear path to adapt the device to the stroke length of a crankshaft to be rolled. The apparatus may be rapidly changed for rolling of crankshafts having different stroke lengths by linearly sliding the individual rolling units relative to the model cranks and thereafter locking the individual rolling units to the model cranks at positions corresponding with the stroke length of the crankshaft to be rolled.

18 Claims, 4 Drawing Figures

METHOD FOR SETTING THE STROKE OF MOVABLE ROLLING UNITS, AND CRANKSHAFT ROLLING MACHINE FOR IMPLEMENTING SAID METHOD

The invention relates to a method for setting the stroke of at least one movable rolling equipment of a crankshaft rolling machine, said equipment carrying rolling dies, where each movable rolling unit is arranged on two associated and turnably supported cranks, whereby each movable rolling unit is shifted in the direction of a desired variation in stroke length by a required and preset amount, and subsequently is locked at the arrived position on associated crank units.

The invention relates further to a crankshaft rolling machine for implementing above method which machine including means to support and guide a crankshaft to be rolled, and by way of an at least one movable rolling unit carrying rolling dies, whereby each movable rolling unit is carried and moved by two main journal stationary and turnably supported and sync-driven, stroke-adjustable crank units.

Prior art processes and crankshaft rolling machines of the initially described type include DOS 31 08 780 and DOS 31 08 717. Machines as these have mechanically moved rolling units, of which the cranks carrying and moving said rolling units are adjustable in their crank radius and that way their stroke. To adjust the stroke of crank pairs carrying and moving said rolling units the latter's lock on the cranks is released, and the rolling units with their machine tools are run over a crankshaft to be processed, which is already clamped into the crankshaft rolling machine on main bearings, and then the rolling dies are closed by a related clamping movement of the rolling units. This way the rolling units being initially loosely arranged on their cranks adjust themselves to the stroke of the clamped crankshaft to be processed, whereupon they are clamped in this position on the crank units, which carry and move them. This way, it was assumed, any new stroke of a crankshaft to be worked would be automatically set the correct way.

To obtain such a setting even with a crankshaft with cranks on different planes and with closely adjoining bearing points additional measures were taken according to the not prior-published German patent application 32 24 268.

This automatic adjustment caused by a newly arrived crankshaft to be processed, however, in very many cases has not been found to be sufficient. With rolling unit adjustments by using the closing pressure and vee-grooving of rolling dies any jam-ups and toe-ins in guides, into which rolling units are sifted, cannot be completely excluded. The required redesign input involved would be indefensibly high. Furthermore, the required space, e.g., for longitudinal guides with roll bodies for reducing the frictional resistance is unavailable. Altogether, therefore, the rolling unit—following the closure of rolling dies involved—obtains its required position not exclusively by shifting but simultaneously by a superposed bending stress of rolling machine dies—carrying units. But this way radial forces being generated on the crankshaft are superposed on rolling forces and endanger the rolling product.

Furthermore, with the prior art spec DOS 31 08 746 a crankshaft rolling machine has been known, where individually and independently movable, mounted rolling units are suspended in such a way that no special stroke adjustment is required. Instead—based on a pivotable mounting on at lease one pivotable mounted lever—said adjustment is automatic. Machines as these, however, enforce a crankshaft introduced drive, which goes beyond one on the work piece itself. Such a lathe drive (aside from the higher equipmental-engineering input involved), which is introduced via the to be worked crankshaft as a work piece, is not always possible because of the connected high torque load on the work piece.

The object of the invention, therefore, is to propose an operating procedure, by which the movable rolling units can be run into a trouble free stroke position, a further object of the invention being to propose a respectively suitable crankshaft rolling machine.

The first object, i.e. with a process for setting the stroke of at least one movable rolling equipment of a crankshaft rolling machine, said equipment carrying rolling dies where each unit of movable rolling equipment—for varying the stroke extent—is arranged in a slideable and lockable way on two associated and turnably supported cranks, and whereby each movable rolling—in the direction of desired variation in stroke length—is shifted by a required and preset amount, and subsequently is locked at the arrived position on the associated cranks, is solved such that the stroke setting is carried out and concluded prior to the pickup of the crankshaft, which is to be rolled, by movable rolling dies. Meaning that the automatic adjustment of rolling units is not carried out any more by the machine tool closure via movable rolling units but that the stroke position being known from the arriving work piece is rather preset independently from the presence of the work piece to be processed in the machine, so that—on arrival of the crankshaft to be processed in the machine—there is already a finally adjusted machine ready for use. Thus no adjustment of machine tools and units to a machine chucked crankshaft to be processed takes place but rather a pre-adjustment of units to the preset stroke measure of a crankshaft to be rolled. This way the crankshaft is not forced any more to pick up setting loads, and any shifting errors and deflections of movable rolling units are avoided.

According to a further development of the process according to the invention provisions are made for the individual and consecutive setting of all movable rolling units. This way the equipmental-engineering input can be reduced, and primarily it makes feasible a careful adjustment of all units by the most simplified means—independently from the cranking position of a crankshaft to be rolled.

According to another development of the process it is proposed to carry out the setting of all movable rolling units simultaneously and in a single setting operation. This brings special advantages with simple and 180°—cranked crankshaft.

Another development of the process according to the invention provides for power operated shifting means for stroke setting required operations, where the shifting path is limited by stops, and whereby the movable rolling units—carrying cranks—prior to the shifting operation—are turned to a position suitable for the latter, and are kept there at least till the next lock-up of shifted units. Measures taken as these allow for a required and precise shifting operation by simple means. No manual shifts and shifting path tests are required. The rolling units about to be shifted are simply moved in position suitable for shifting purposes. This is the position, which enables the shifting means to actually shift the rolling unit. This means that the guide surfaces, on which the shift takes place, and the moving direction of power operated shifting means must lie in identical or parallel planes. In this position any shift is made simply to the extent of a preset limit stop, the presetting of which is no problem because the required stroke positions, of course, are well known. These proposed measures then allow for a problem free, required and precise shifting operation by avoiding any manual shifting and testing input.

Finally in a further development of the process according to the invention it is proposed that all cranks for shifting movable rolling units be placed in the same plane whilst movable rolling equipment is shifted. This makes it feasible to centralize in an equipmental-engineering sense the units required for shifting and shifting limits, namely the stops, so that any required tests can be carried out on a uniform basis.

Another initially described object of the invention, i.e., a crankshaft rolling machine for implementing the process according to the invention by means for supporting and guiding a crankshaft to be rolled, and having an at least one movable rolling unit carrying rolling dies, whereby each movable rolling unit is carried and moved by two main journal stationary and turnably supported and sync-driven, stroke-adjustable cranks in the machine, is solved such that with each movable rolling unit to be shifted in the machine a power operated shifting device and a shifting limit stop is associated. This power operated shifting device takes care of a safe shift extending to a shift limit stop. Meaning that the shifting power does not have to be provided any more by the work piece to be processed but is supplied by a separate shifting device. The exact shifting position is defined by a stop. After the rolling unit has been shifted by the shifting device against the associated stop said rolling unit is clamped in between the power operated shifting device and the stop. In this situation it is clamped against the associated crank resp. associated crank pair, whereupon the shifting device and stop can be removed from the effective field of movable rolling units. Now the latter have been set to a correct stroke, however, the work piece has remained completely under zero load. Because the work piece stroke is precisely known as is the work piece chucking position in the machine no uncontrolled sizeable or directional rolling forces are effective.

In an inventive development of this invention it is proposed that each power operated shifting device takes the form of a flow medium cylinder, which interacts with a stop face being associated with a respectively movable rolling unit. Flow medium cylinders are reliable design elements, which are simple to build and operate and are low-priced. They carry out a linear motion, which that way does not require any more any moving-directional translation for rolling units to be shifted. Their only required contact with rolling units is a simple stop face, against which the respectively movable element of the flow medium cylinder can be laind for transmitting the power shift.

Accordng to another development of the invention a provision is made for arranging all power operated shifting devices in one and the same plane. This way the entire machine design size can be minimized and the assembly simplified. In this case also the visual monitoring of the correct operation of power operated shifting devices can be simplified.

Accoridng to a supplemental development of the invention provisions are made for arranging the flow medium cylinders and limiting them in their stroke to the effect that they—being in a retracted state—don't impede the motion of rolling units. Because during operations all points of movable rolling units move in a circular path the flow medium cylinders with their piston rods—following their carried-out shifting work—must be removed from that surface area, which is affected by the motion of rolling units. This can be done, e.g., in a simple way by keeping the cylinder bodies themselves out of this area and letting only the piston rods enter this area during the shifting operation. What remains to be done then following the shifting work is simply to retract the piston rods for the purpose of eliminating any operational obstruction of movable rolling units. Though this requires a flow medium cylinder having a larger stroke this also can save a separate shifting-and swiveling device for all flow medium cylinders plus an associated power operated device.

The provision made in a still further development of the invention is for the operation of power operated shifting devices individually and independently from each other and/or on a common and simultaneous basis. Thus in the most imaginably simplest way it becomes feasible either to vary the stroke position of only some of the movable rolling units, which is desirable, e.g., in cases where crankshafts each having a different stroke and plurality of stroke bearings are to be processed on the same machine, or as an alternative to shifting all movable rolling units simultaneously, which saves time in cases where crankshafts with identical amounts of stroke bearings but different strokes are to be processed.

Again in a related development of the invention provides for all stops being associated with movable rolling units to be arranged in the same plane. This way the positioning of stops within the entire machine is simplified because always the same test base in the machine can be used. Furthermore this simplifies the design of stops.

In a further supplemental development of the invention it is proposed that the stops in a common guide device are single-adjustable arranged and guided. This minimizes the total design input for stops and still results in a high setting flexibility for said stops.

In a still further supplemental development of the invention a proposal is made for having stops interact with an adjustable device common to all stops. This common adjustable device takes care in a simple way of a synchronized adjusting of all stops simultaneously. This means a further simplification of design input and a reduction in setting time.

Again according to a development of the invention a provision is made for shifting device motions and stop-adjusting motions to take place on identical or parallel effective lines in identical or parallel planes. This simple way any cants can be avoided to a large extent.

In another supplemental development of the invention a proposal is made for equipping the adjusting device with a shifter piece being slideably arranged in the guide device across the stops, said shifter piece being provided with a cant for at least each stop, against which cant the respective stop abuts. This gives a particularly advantageous and simple stop adjusting device, which operates reliably, is simply adjustable and manageable and can be built to a sufficiently rigid degree for making each resp. stop also actually meet it functional requirement per se.

According to a supplemental development of the invention a proposal is made for said shifter piece to comprise at least a stop matching plurality of single shifter pieces each having a cant for stop abutment, whereby said single shifter pieces are detachably interconnected. This simplifies production and assembly to a high degree and makes it feasible to grind the cants of all shifter pieces in a single chucking operation, which eliminates any mutual canting errors. The detachable interconnection of single shifter pieces offers the use of a single shifting drive for all shifter pieces.

According to another development again a provision is made for said shifter piece having a further cant or for a further single shifter piece having a cant, whereby said further cant interacts with a guide device controlled sensor or measuring means. This represents a particularly simple design for operating a sensor in sync with the operation resp. adjusting of stops, whereby said sensor can have an optical readout resp. serve to control a position drive.

Another development of the invention again provides electronic position sensors for determining the stop-adjusting path, said sensors interacting with an adjusting device position drive and suitable control to the extent that following the run-through of a desired adjusting path the position drive cuts out. Because all stops in the machine assume a specified preset position relative to said machine the adjusting path extent of single stops can be easily determined via a position drive. For this purpose the job to be done by electronic sensors being known per se is only to test the mechanical shifting path of stops or the mechanical shifting path of a component effecting the shift of stops, and to compare it with a preset variable. The latter can be a positioning value to be put into the machine control. On reaching said preset variable during the adjusting process the associated position drive is cut out via the control involved.

Again a related development of the invention provides for at least the shifter piece or interconnected single shifter pieces to be connected to the stationary (relative to the guide device) arranged position drive via a ball roller spindle having a nut. Said connection of the entire shifter piece or interconnected single shifter pieces to a nut for a ball roller spindle, which in turn then interacts with said ball roller spindle, whereby said spindle is driven by a position drive, is conceivably the simplest type of a precisely monitorable shifter piece displacing path and that way of a matchingly precise timing of stops.

According to an alternative development of the invention provisions are made for having movable rolling units following their shift to a desirable stroke variable abut on a resp. template operating as a stop, which blocks any further shift, the template profile matching the desired shifting length of movable rolling units involved. Then always in cases, where only a few of different crankshafts are to be rolled on one and the same machine it will be feasible to relinquish a continually variable adjusting of stops. Because movable rolling units following their setting to a desired stroke assume a specified relative position to each other this relative position can be fixed then by a template abutting on the rolling units involved. In this case the template can be interchangeably developed to have the position of movable rolling units matching each known stroke fixed via said template means. With each specifically known stroke then a template is associated.

In a further supplemental development of the invention a provision is made for assigning a template magazine contained templated to each desired rolling unit stroke position. With such an arrangement the resp. template does not have to be interchanged but a matching motion or swivel by the template magazine containing all required profiles is sufficient for getting the desired pattern in stop position.

Equally according to a development of the invention a provision is made for arranging all stops on a mobile carrier, by which said stops can be removed from the moving range of rolling units involved. This way any removal of stops following the adjustment of movable rolling units can be avoided.

A supplemental development of the invention specifies also that said mobile carrier is formed as adoublearmed lever, the pivoting bearing of which is attached to the machine column, and on one end of which the stops are provided, and the other of which is connected to an operating device. Such a design, by which the stops simply can be swiveled away is the conceivably simplest solution for removing the stops from the moving range of movable rolling units.

A further development of the invention proposes that the mobile carrier in the stop-operating position be driven against a positive stop, which determines that limit stop position. By way of said positive stop the precise position of stops effected by the precise positioning of the mobile carrier can be determined with repetitive accuracy so that the use of matching setting devices or stops within the operating device can be relinquished and, moreover, any detrimental effects from elastic deformations of the overall device can be avoided.

According to a still further supplemental proposal of the invention the shifter devices are to be arranged on the side away from the rolling die side while the shift limit stops are provided on the rolling die side. The development—in connection with a further proposal of the invention, according to which the stops be formed by a crankshaft to be rolled itself—has the advantage that the crankshaft being used as a stop can—after meeting it operational function—be inserted into rolling dies without any trouble.

The invention will be explained in more detail below with reference to drawings showing an exemplified embodiment, wherein FIG. 1 shows a cut along line I—I according to FIG. 2, by including a hydraulics-and drive schematic;

The basic assembly of crankshaft rolling machines as these—according to the state of the art cited initially and that given in the initially cited literature—can be retained. The basic mechanical assembly, therefore, will not be discussed in any more detail. In the upper area of a prior art crankshaft finish rolling machine two cranks (8 and 9) being formed as complete crankshafts in equally prior art style are drive-unit turnably supported as so called master shafts. For drive unit purposes the cranks (8 and 9) are connected to a driving pinion (50) via gearwheels (48 and 49), said pinion in turn being driven by a not further described prior art driving motor. To practice the invention there is no basic requirement for forming said cranks (8 and 9) as complete crankshafts. Without detracting from the invention the use of single cranks is made feasible both in a process and design engineering sense according to the initially described state of the art design.

Figure 2:
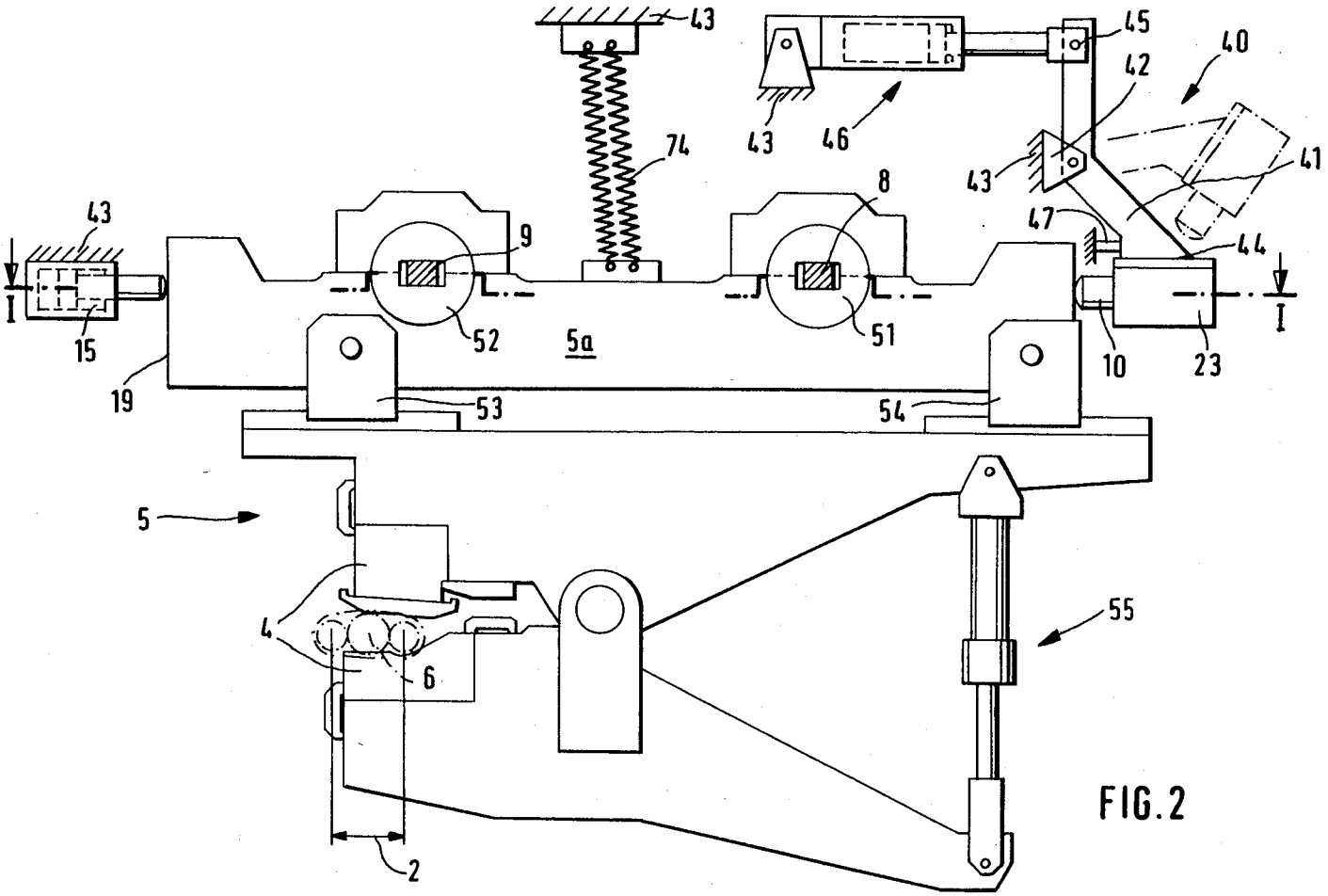
FIG. 2 shows a cut in the direction of arrow B according to FIG. 1.

With cranks as these—independently from the design of cranks (8 and 9) operating as master shafts—the stroke bearing journals are rectangular or square, preferably square cross-sectionally formed. Each of said preferably square cross-sectionally formed bearing journals is—as exemplified by the unit shown in FIG. 2—arranged in a disk (51) resp. (52) having a cross-sectionally matching slot. To simplify the assembly both disks (51 and 52) are composed of two halves, said disks on their parts being turnably arranged in bores of a carrier 5*a* (this applied also to carriers (5*b*, 5*c* and 5*d*). The square necks of cranks (8 and 9) are equipped with a preferably hydraulic-operated clamping device, by which a squeeze is produced at any point within the slot of disks (52 and 51). Due to this structural design the carrier 5*a* (FIG. 2) can be shifted within the slot area on cranks (8 and 9), which produces a variation in stroke. This prior art assembly has been described in DOS 31 08 780 , description parts to FIGS. 2*a*, 3, and 4 to which specific reference is made.

To carrier (5*a*) being connected—slideably and clampably as described above—to cranks (8 and 9) operating as master shafts there is attached a movable rolling unit (5) via clamp brackets (53 and 54), said rolling unit being pliers-like designed and carrying on its front end the upper-and lower parts of a rolling die (4) and on its rear end being operated by a hydraulic cylinder (55). The prior art design and operation of movable rolling units (5) as these, too, is described, i.g., in DOS 31 08 780, and to which, too, reference is made. Meaning that up to this point only the design of a prior art crankshaft finish rolling machine has been described.

Additionally provided for said prior art design there are power operated shifting devices (15, 16, 17 and 18) in the same plane being formed as flow medium cylinders and connected to machine column (43). In exemplified embodiment (FIG. 1) a four-stroke, 180°-cranked type crankshaft is provided for machining purposes. Accordingly there are provided four movable rolling units, which are arranged as described in FIG. 2 among carriers (5*a*, 5*b*, 5*c*, and 5*d*).

Figure 1:
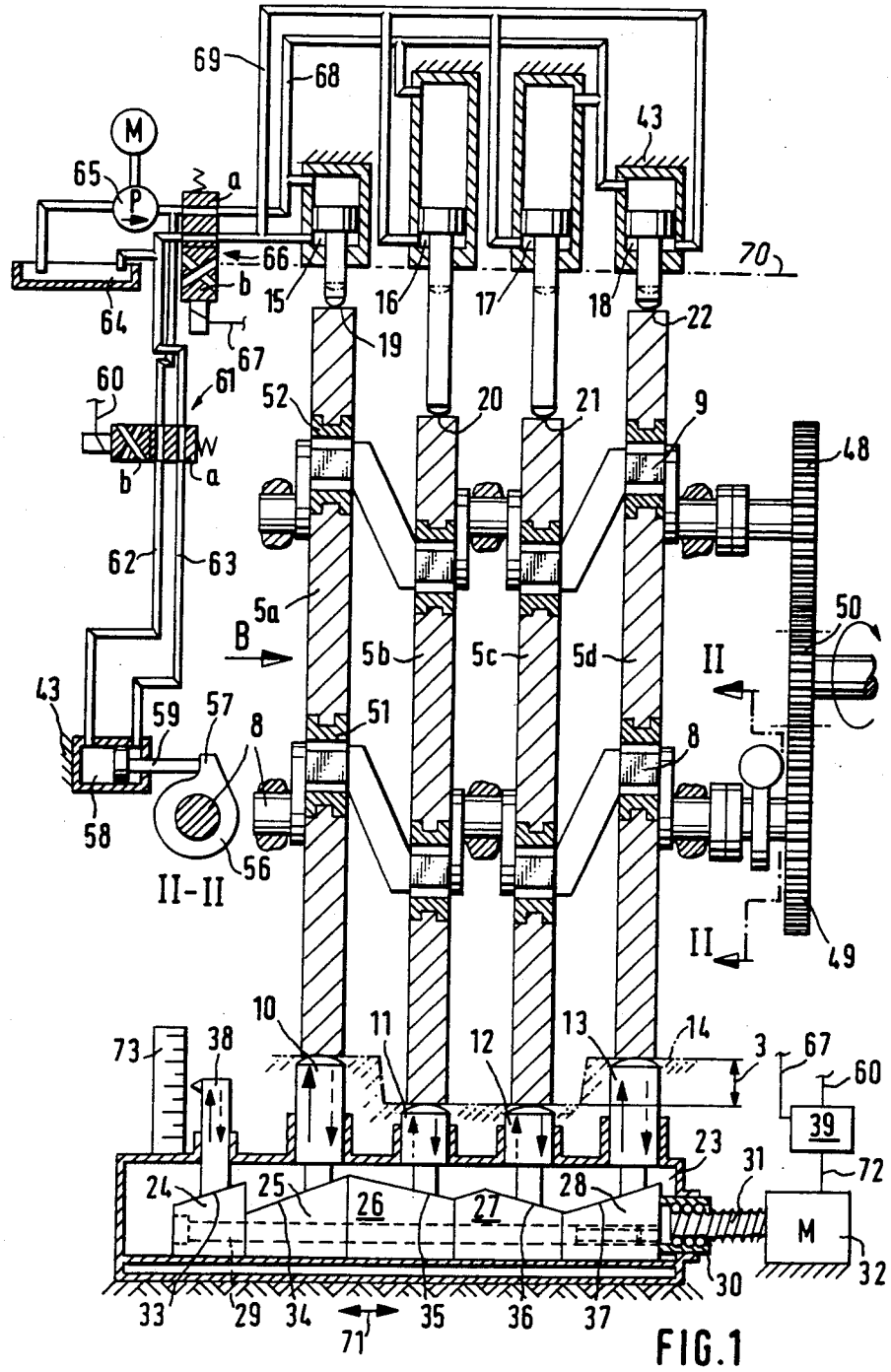

For stroke setting purposes the cranks (8 and 9) operating as master shafts are run in—via an equally prior art end cutour—to such a pivoting position that the crank (8 and 9) stroke bearings lie in the same horizontal plane, which is the plane of projection as shown in the examplified embodiment according to FIG. 1. To pinpoint this to a maximal degree there is, e.g., on the free end of crank (8) a torque-tight stop cam (56) arranged, said cam having a nose (57). The end cutout is so set that nose (57) somewhat overruns the desired pivoting position before it comes to a dead stop. On machine column (43) a suitably positioned flow medium cylinder (58) is arranged, said cylinder's piston rod (59) being enabled to run against nose (57). An internal stop of flow medium cylinder (58) takes care that piston rod (59) in a completely run-out state, where said cylinder (58) internal stop becomes effective, has returned nose (57) to such an extent that now the cranks (8 and 9) precisely assume the desired pivoting position. For this purpose a control pulse from controller (39) is fed to the operating device of valve (61) via control line (60), which triggers said valve (61) to move into switching position a. At said setting position a pump (65) takes care that pressure medium is fed to flow medium cylinder (58) via line (62) and that way effects a runout of piston rod (59). Any oil displaced by said runout motion is carried off to take (64) via line (63).

On reaching a desired pivoting position as described the squeeze on the stroke journals of cranks (8 and 9), by which the carriers (5*a* thru 5*d*) and that way associated movable rolling units are locked on said cranks (8 and 9), is released. Said squeeze and release may take place as described in prior art DOS 31 08 780, and specifically in FIGS. 2*a*, 3, and 4 of that DOS-citation.

Now after the carriers (5*a* thru 5*d*) on the stroke journals of cranks (8 and 9) have resumed their slideability because of the release of clamping force the flow medium cylinders (15 thru 18) can be operated with the cylinders, themselves being stationary attached to machine column (43). The operational runout of only generally indicated flow medium cylinder piston rods abuts against stop faces (19, 20, 21, and 22) of associated carriers (5*a* thru 5*d*) so that on any further running out of piston rods said carriers (5*a* thru 5*d*) are shifted in the direction of run-out piston rods. For this purpose the described positioning of cranks (8 and 9) to the desired pivoting position is required to put the shifting direction of piston rods and the slide forces for shifts into identical or at least parallel planes. In this case it is of particular advantage of having said planes laid most closely together. For operating said flow medium cylinders (15 thru 18) in the run-out direction a control (39) pulse is fed to the operating device of valve (66) via control line (67), so that said valve is triggered to run into switching position a. In said position all of said flow medium cylinders are supplied with pressure medium via line (68), whereby simultaneously displaced pressure medium can run off into tank (64) via line (69). For a reverse motion of flow medium cylinder (15 thru 18) piston rods, meaning for their return motion, the valve (66) is triggered to go into switching position b by a control pulse given via line (67). This way a flow medium circulatory reversal is effected.

In the arrangement according to FIG. 1 the central movable rolling units and their carriers (5*b* and 5*c*) are shown in a set-back position. Yet the piston rod sided front of flow medium cylinders (15 thru 18) is arranged in the same plane (70) with any other front. This requires that flow medium cylinders (16 and 17) have a considerably larger stroke than cylinders (15 and 18) so that also carriers (5*b* and 5*c*) resp. their stop faces (20 and 21) can be reached by the piston rods of flow medium cylinders (16 and 17) and shifted to the desired stroke position. This disadvantage of using various flow medium cylinder stroke lengths for carrying out and shifting motions, however, is compensated by the advantage that all that is required is simply to retract the piston rods of said flow medium cylinders for removing them from the moving range of carriers (5*a* thru 5*d*). Thus no motion by all flow medium cylinders is required any more.

In the exemplified embodiment itself the flow medium cylinders (15 thru 18) responsible for any shifting motion have no tester devices, by which the extent of shifts could be determined, because they come to a stop only on carriers (5*a* thru 5*d*) resp. their stop faces (19 thru 22). Said carriers (5*a* thru 5*d*) are shifted by cylinders (15 thru 18) piston rods to the point, where they come to a stop with their back side on stops (10 thru 13).

In the exemplified embodiment the stops (10 thru 13) are formed as cylindrical pins, which—in an operational direction, into which on a stroke adjusting the carriers (*5a* thru *5d*) are shifted—are slideably arranged in a guide device (23) common to all pins. Moreover, the stops (10 thru 13) inside guide device (23) abut on associated cants (34, 35, 35 and 37), which are shaped on single shifter pieces (25, 26, 27 and 28). Furthermore, the guide device (23) is provided with a tester (38) element which being controlled and arranged as are the stops (10 thru 13) abuts on the cant (33) of a single shifter piece (24). All cants (33 thru 37) are inclined to the same extent, however, cants (35 and 36) by contrast with the others have a reverse-directional inclination.

All single shifter pieces (24 thru 28) are interconnected via a connecting bolt (29) and can be shifted as a whole within the guide device (23) in the direction of arrow (71). Said shifting motion in the direction of arrow (71) takes care of a directinal shift of stops (10 thru 13) and tester (38) perpendicular to said arrow (71), the extent of which shift being a function, too, of the inclination of cants (33 thru 37).

Because of the described alternating inclinational direction also the stops (10 thru 13)—on a shift produced by single shifter pieces (25 thru 28) in the direction of arrow (71)—move in the reverse direction of stops (11 and 12). Such an arrangement, however, is not binding but a function of crankshaft design. The sequency of cants (34 thru 37) must be provided as a function of this design. In the exemplified embodiment then, e.g., if based on the shown state the stroke extent is to be decreased then stops (10 and 13) would run into the guide device (25) while stops (11 and 12) would move in the reverse direction. In this case respectively same-directinally moving stops would cover also the same distance.

The shifting motion of all single shifter pieces (24 thru 28) is produced by a position drive (32)-driven ball roller screw, which interacting with a nut (30) for said screw in turn interacts appropriately with interconnected single shifter pieces (24 thru 28). Thereby the position drive (32) is rigidly attached to guide device (23).

The guide device (23), in this case together with the entire position drive (32), is attached to the end (44) of a double-armed lever (41), the pivoting bearing (42) of which is attached to machine column (43). The second end (45) of said lever (41) is connected to an operating device (46) being formed as a flow medium cylinder, said device in turn being attached with its free end to machine column (43). If flow medium cylinder (46) is supplied the prior art way with enough pressure medium to the extent that the (only generally indicated) piston rod slides out then according to the arrangement shown the double-armed lever (41) drives against a dead stop (47) being arranged on machine column (43) so that guide device (23) and associated stops (10 thru 13) are put in a definitely preset position. A reverse operation of flow medium cylinder (46) effects a swiveling away of guide device (23) into a position as shown by a dotted line in FIG. 2. The described device, therefore, forms a mobile carrier (40) by which required stops can be brought into working position or swiveled away.

Assuming that following the machining of one crankshaft type another (6) one having a different stroke (2) is to be rolled then for this purpose the movable rolling units (5) must be shifted via their carriers (*5a* thru *5d*) into above described position and procedure by flow medium cylinder (15 thru 18) piston rods for said units (5) to assume the new desired stroke position. To effect this the stops (10 thru 13) must be so traversed that if carriers (*5a* thru *5d*) come to an abutment on stops (10 thru 13) the way as shown in FIG. 1, then said carriers and associated movable rolling units (5) can assume the desired stroke position. To achieve this, e.g., the stroke difference from the preceding crankshaft can be established and put into control (39), which in turn triggers the position drive (32) via control line (72), said drive being enabled to move the single shifter pieces (24 thru 28) in the direction of arrow (71) and that way to effect a variation in the position of stops (10 thru 13). In this case the sense of position drive (32) rotation determines the traversing direction of stops (10 thru 13). In this case the traversing path can be deduced from control (39), e.g., via screw pitch and run-off rpm, for dead-stopping again said position drive (32) according to a suitable shifting variable. But this makes it feasible also to test the actually covered shifting distance via a suitable sensor or, e.g., via a tester element (38), and then, on establishing the preset shifting path length in the correct direction via said tester element (38) to dead-stop said position drive (32). Additionally said tester element (38), e.g., can produce a visual indication via a scalar readout (73). The testing of a specified traversing variable and run into a preset position, by means of which specified machine elements are run into preset positions, is basic knowledge in electronic engineering and, therefore, will not be discussed any more in any more detail.

After the run of stops (10 thru 13) into their new position the now freely shiftable carriers (*5a* thru *5d*) can be shifted against said stops and kept there by means of flow medium cylinder (15 thru 18) piston rods. In this state the carriers (*5a* thru *5d*) are clamped in on the stroke bearings of cranks (8 and 9) via clamping devices, which lock them in their reached position,. Clamping devices as these and their operation are described in DOS 31 08 780 and shown in FIGS. *2a*, 3 and 4 of said cited DOS, so that at this point their description can be omitted. Now after carriers (*5a* thru *5d*) are reclamped in the desired stroke position the flow medium cylinder (15 thru 18) piston rods are run in again, and the mobile carrier (40) with stops (10 thru 13) being arranged on it is swiveled out into the position shown in FIG. 2 by a dotted line, whereupon the crankshaft rolling machine again is operational with regard to stroke timing operations.

By means of a logical selection of carrier (*5a* thru *5d*) lengths a forced bridgeover by stops (10 thru 13) covering the total stroke length can be avoided. The only adjusting requirement in this case is that stops (10 thru 13) bridge the total stroke differential (3) effective between the crankshaft having the minimal stroke and the crankshaft having the maximal stroke to be rolled on this machine. Assuming that in the exemplified embodiment according to FIG. 1, e.g., a position for maximal stroke setting is shown. Now by reversing the situation and running out the inner stops (11 and 12) exactly as the outer stops (10 and 13) in the presently shown situation, and reversely running in said outer stops (10 and 13) as far back as the presently arranged inner stops (11 and 12) then a setting to the minimal stroke is accomplished. A matching longitudinal adjusting of carriers (*5a* thru *5d*), therefore, seems logical for reducing stop (10 thru 13) operational variables.

But it is not absolutely necessary to provide operationally variable stops the way of stops (10 thru 13). Given a limited amount of stroke variables it becomes feasible also, e.g., to use a fixed template as a stop as is schematically sketched in FIG. 1 and designated by (14). Under varying stroke conditions said template (14) can be interchanged with a dimensionally varied template of the same type, so that again the required type of stop is available. Conceivably also is a plurality of templates (14) as these, which are indexed to differential strokes, to be accommodated in a (now shown here in any detail) template magazine so that an automatic interchange of templates can take place as a function of required stroke variable.

Figure 3:
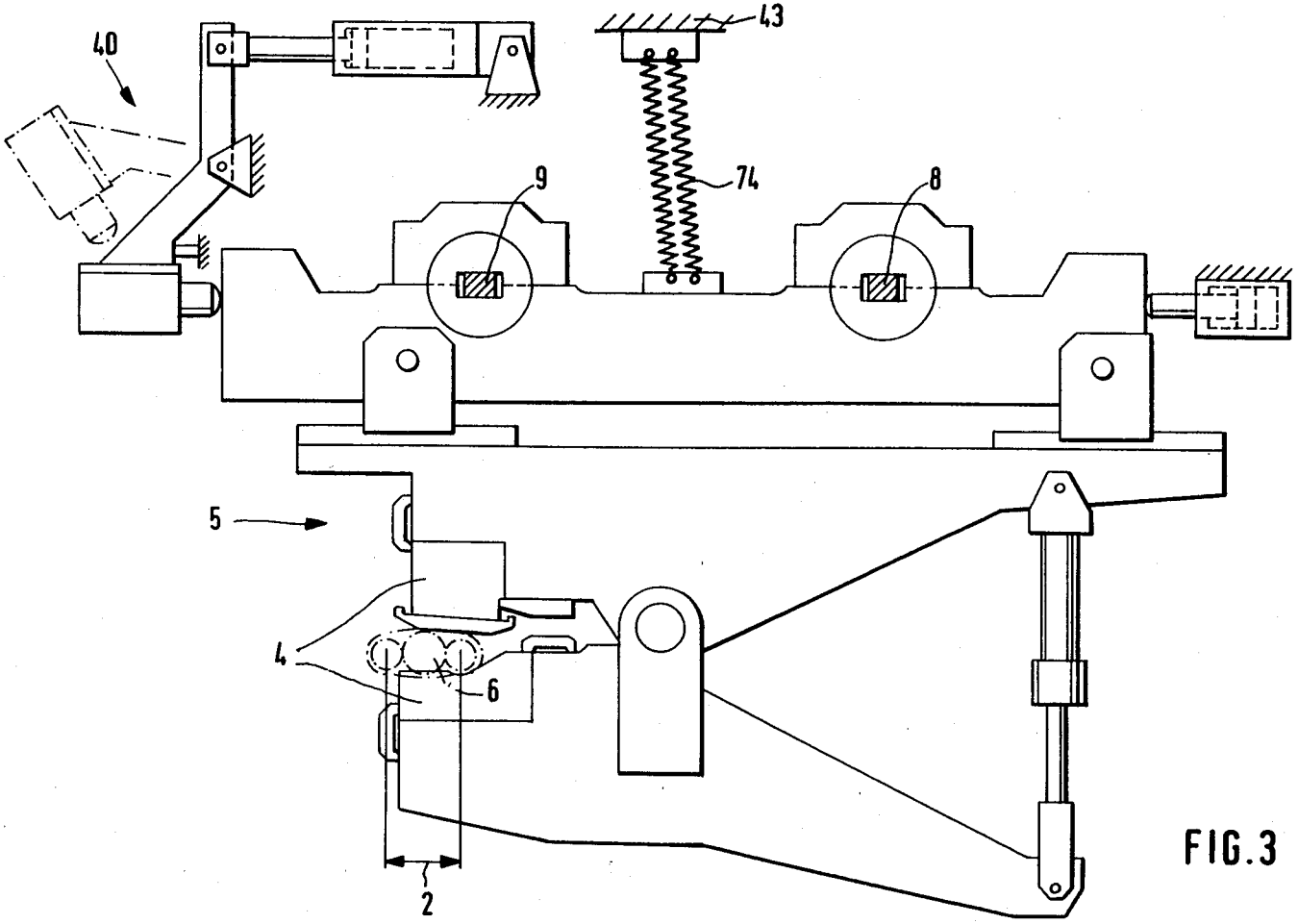
FIG. 3 shows a cut according to FIG. 2 but with reverse-arranged stop-and shifting devices.
Figure 4:
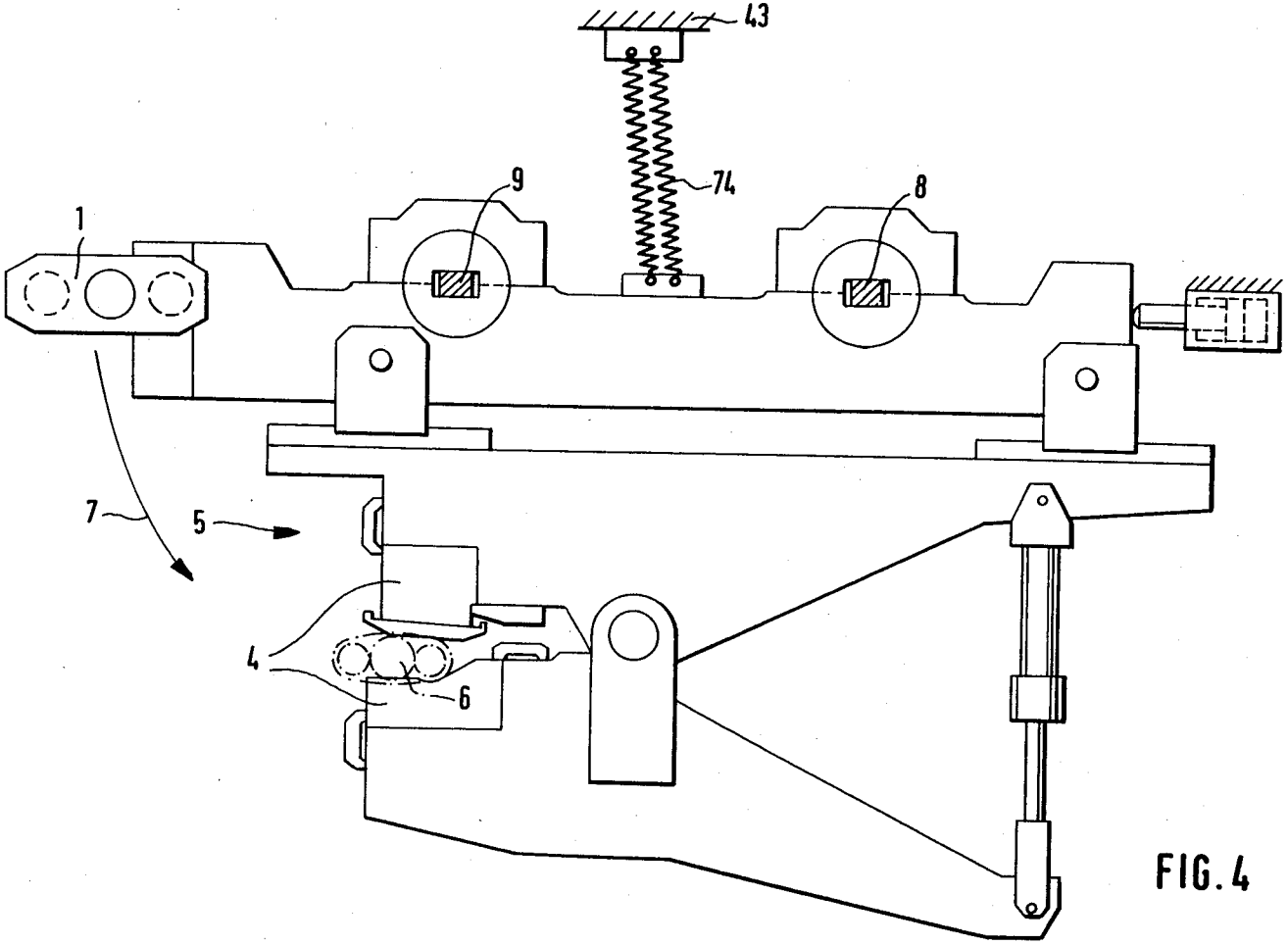
FIG. 4 shows a cut according to FIG. 3 by using a work piece-crankshaft as stop.

Furthermore, no problem would been countered by reversing the arrangement (according to FIG. 2) of flow medium cylinders (15 thru 18) and mobile carrier (40) having stops attached to it as shown in FIG. 3. Said arrangement according to FIG. 3 has its advantages even in cases where instead of stops (10 thru 13) or particularly instead of stop template (14) the crankshaft-to-be-rolled itself is used as stop type crankshaft for carrier (5 thru 5*d*) settings as schematized in FIG. 4. In this case then the mobile carrier (40) being arranged according to FIG. 3 is to be in position for picking up crankshaft (1) by way of stop template (14) for stroke setting purposes. After carriers (5*a* thru 5*d*) are set—as with above stop template (14)—to the new stroke by means of crankshaft (1) operating as stop template said crankshaft (1) can be moved in the direction of arrow (7), and tools (4) can be inserted for machining purposes.

On setting a new stroke and getting the machine operational again the piston rod (59) of flow medium cylinder (58) must be retracted into switching position b by a switchover of valve (61) to the extent that it lies outside the circular motion of nose (7) with the result that cranks (8 and 9) are enabled during the subsequdent machining process to turn freely. For an added relief of said cranks (8 and 9) the carriers (5*a* thru 5*d*) and that way their associated movable rolling units (5) are suspended from machine column (43) via springs (74) in such a way that said springs (74) carry the main load. This way any undersirable deformation of cranks caused by systemic weight feed (8 and 9) can be minimized.

The process according to the invention allows for accomplishing a setting to various strokes with crankshaft rolling machines, by which rolling units are put in a correct stroke position such that the work piece to be rolled remains unaffected by uncontrollable forces. The work piece itself is not required any more as a setting means.

The design of a machine according to the invention for implenenting said process allows for the precise setting of rolling units to the respectively required stroke by the simplest—and substantially automatic—means. This way the design of prior art machines can be retained to a large extent with the added potential of retrofitting already existing machines.

Having thus described our invention, what we claim as new and desire to secure by Letters Patent of the United States is:

1. The method of setting the stroke length of at least one movable rolling equipment unit of a crankshaft rolling machine, said unit including rolling dies adapted to support a crankshaft to be rolled and being mounted on a pair of synchronously rotatably supported cranks, said unit being movable relative to said cranks in a linear path corresponding to the desired stroke and being lockable relative to said cranks at selected positions along said path comprising the steps of shifting said unit along said linear path to a selected position relative to said cranks in accordance with the desired stroke length, causing said unit to be clampingly connected to said cranks at said selected position, and thereafter introducing said crankshaft to be rolled into said dies.

2. The method of claim 1 wherein said crankshaft rolling machine includes a plurality of said units and including the steps of shifting each said unit individually to said selected position relative to said cranks.

3. The method of claim 1 wherein said crankshaft rolling machine includes a plurality of said units and including the step of simultaneously shifting said units to said selected position.

4. The method of setting the stroke length of a crankshaft rolling machine, said rolling machine comprising a pair of synchronously rotatably supported model cranks, a plurality of parallel rolling equipment units mounted on said cranks, each said unit including rolling dies adapted to support a crankshaft to be rolled, said units being mounted on said cranks for movement along linear paths parallel to the desired stroke and being clampable to said cranks at selected positions along said paths comprising the steps of providing a template having a stop portions corresponding in number to the number of said units, causing said stop portions to be disposed in said paths, causing said units to be shifted into engagement with said stop portions of said template, thereafter clamping said units to said cranks while said units are engaged against said stop portions, and thereafter positioning a crankshaft to be rolled in said dies of said units.

5. The method of claim 4 wherein said template comprises movable stop portions and including the step of adjusting said stop portions in the direction of said path in advance of causing said units to be shifted into engagement with said stop protions.

6. A crankshaft rolling machine comprising a pair of model cranks, means for synchronously rotating said cranks about parallel axes of rotation, at least one rolling equipment unit supported on said cranks, said cranks being rotatable relative to said unit, means for shifting said unit along a linear path relative to said cranks, clamp means interposed between said cranks and said unit for fixing said unit at a selected position along said linear path corresponding to a desired stroke length, rolling die means mounted on said unit for supporting a crankshaft to be rolled, powerized means operatively associated with said unit for shifting said unit in said linear path, and stop means in said path positioned to limit the movement of said unit shifted by said powerized means.

7. A rolling machine in accordance with claim 6 and including a plurality of said units supported on said cranks, the paths of movement of said units being parallel.

8. A crankshaft rolling machine comprising a pair of model cranks, means for synchronously rotating said cranks about parallel axes of rotation, a plurality of rolling equipment units supported on said cranks, said cranks being rotatable relative to said units, means for shifting said units along parallel linear paths relative to said cranks, clamp means interposed between said cranks and said units actuable between releasing and clamping positions said clamp means in said clamping position fixing said units at selected positions along said linear path corresponding to selected stroke lengths of a crankshaft to be rolled, rolling die means on said units for supporting said crankshaft to be rolled at axially spaced position therealong, powerized means operatively associated with each said unit for shifting the associated said unit in its respective path independently of the other said units in the releasing position of said clamp means and stop means disposed in the path of each said unit to limit the movement of said units shifted by said powerized means in accordance with a selected stroke length.

9. A crankshaft rolling machine in accordance with claim 8 wherein said powerized means each comprise a piston and cylinder assembly.

10. A crankshaft rolling machine in accordance with claim 9 wherein said powerized means are adapted to be shifted simultaneously to a position spaced from said units.

11. A crankshaft rolling machine in accordance with claim 8 wherein said stop means comprises a template member including a plurality of stop portions, each said stop portion being aligned in a said path of a said unit.

12. A crankshaft rolling machine in accordance with claim 8 wherein stop means are independently movable in said paths.

13. A crankshaft rolling machine in accordance with claim 12 wherein said stop means includes a plurality of plungers, each said plunger being shiftable in one of said paths, and cam means operatively associated with said plungers for shifting said plungers selected distances along said paths responsive to predetermined movements of said cam means.

14. A crankshaft rolling machine in accordance with claim 13 wherein said cam means comprises a plurality of detachably interconnected cam members.

15. A crankshaft rolling machine in accordance with claim 13 and including measuring means operatively associated with said cam means.

16. A crankshaft rolling machine in accordance with claim 13 and including threaded means operatively connected to said cam means for shifting said cam means in a direction perpendicular to said paths responsive to rotation of said threaded means.

17. Apparatus in accordance with claim 8 and including means for shifting said stop means clear of said path.

18. Apparatus in accordance with claim 8 wherein said stop means comprises a crankshaft configured to correspond to a said crankshaft to be rolled.

* * * * *